US010166445B2

(12) United States Patent
Brandt

(10) Patent No.: US 10,166,445 B2
(45) Date of Patent: Jan. 1, 2019

(54) GOLF PUTTER HEAD ASSEMBLY AND METHOD OF USE

(71) Applicant: Richard A. Brandt, New York, NY (US)

(72) Inventor: Richard A. Brandt, New York, NY (US)

( * ) Notice: Subject to any disclaimer, the term of this patent is extended or adjusted under 35 U.S.C. 154(b) by 0 days.

(21) Appl. No.: 15/431,135

(22) Filed: Feb. 13, 2017

(65) Prior Publication Data

US 2017/0239535 A1 Aug. 24, 2017

Related U.S. Application Data

(60) Provisional application No. 62/298,277, filed on Feb. 22, 2016.

(51) Int. Cl.

| | |
|---|---|
| ***A63B 53/04*** | (2015.01) |
| ***A63B 53/06*** | (2015.01) |
| ***A63B 53/02*** | (2015.01) |

(52) U.S. Cl.

CPC ..... *A63B 53/0487* (2013.01); *A63B 53/02* (2013.01); *A63B 2053/026* (2013.01); *A63B 2053/028* (2013.01); *A63B 2053/0491* (2013.01)

(58) Field of Classification Search

USPC ..... 473/305–315, 324–350

See application file for complete search history.

(56) References Cited

U.S. PATENT DOCUMENTS

| | | | | | |
|---|---|---|---|---|---|
| 786,268 | A * | 4/1905 | Corey et al. | A63B 53/0487 | 473/325 |
| 1,116,022 | A * | 11/1914 | Cornwall | A63B 59/60 | 473/311 |
| 1,250,296 | A * | 12/1917 | Fitzjohn et al. | A63B 53/0487 | 473/313 |
| 1,478,483 | A * | 12/1923 | Meurisse | A63B 59/60 | 264/342 R |
| 1,548,081 | A * | 8/1925 | Wilson | A63B 53/00 | 473/293 |
| 2,155,830 | A * | 4/1939 | Howard | A63B 53/06 | 473/246 |
| D138,380 | S * | 7/1944 | Myers et al. | | 473/325 |

(Continued)

FOREIGN PATENT DOCUMENTS

| | | | | |
|---|---|---|---|---|
| FR | 2834647 A1 * | 7/2003 | | A63B 53/02 |
| GB | 2403657 A * | 1/2005 | | A63B 53/04 |

(Continued)

*Primary Examiner* — Alvin Hunter

(74) *Attorney, Agent, or Firm* — R. Neil Sudol; Henry D. Coleman

(57) ABSTRACT

A head assembly for a golf putter includes a head piece, a hosel or connector for attaching a putter shaft to the head piece, and a releasable clamping element. A body portion of the hosel is formed with a concavity defined by a cylindrical concave surface. A finger extension of the hosel has a bore for receiving an end of a putter shaft. The head piece includes an elongate body having a putting face on one side and a cylindrical convex surface on an opposite side. The cylindrical convex surface is insertable into the concavity in the hosel body and is engageable with the cylindrical concave surface thereof. The clamping element adjustably fixes the hosel and the head piece to one another.

10 Claims, 14 Drawing Sheets

(56) References Cited

U.S. PATENT DOCUMENTS 2,478,468 A * 8/1949 Drake ..... A63B 53/0487 473/313
3,226,120 A * 12/1965 Borah ..... A63B 59/60 473/325
D211,586 S * 7/1968 Wozniak et al. ..... 473/325
3,430,963 A * 3/1969 Wozniak ..... A63B 53/007 473/251
3,675,923 A * 7/1972 Allen ..... A63B 53/007 473/313
3,908,996 A * 9/1975 Molinaro ..... A63B 59/60 473/293
3,966,210 A * 6/1976 Rozmus ..... A63B 53/0487 473/341
4,010,958 A * 3/1977 Long ..... A63B 53/0487 172/371
4,290,606 A * 9/1981 Maxwell ..... A63B 53/007 273/129 K
4,736,951 A * 4/1988 Grant ..... A63B 53/06 473/246
4,898,387 A * 2/1990 Finney ..... A63B 53/0487 473/341
5,090,698 A * 2/1992 Kleinfelter ..... A63B 53/0487 473/313
5,193,806 A * 3/1993 Burkly ..... A63B 53/04 473/309
5,362,056 A * 11/1994 Minotti ..... A63B 53/0487 473/251
5,390,919 A * 2/1995 Stubbs ..... A63B 53/065 473/246
5,447,310 A * 9/1995 Jernigan ..... A63B 53/0487 473/330
5,533,730 A * 7/1996 Ruvang ..... A63B 53/02 473/251
5,580,058 A * 12/1996 Coughlin ..... A63B 69/3685 273/250
5,688,189 A * 11/1997 Bland ..... A63B 53/065 473/314
5,749,790 A * 5/1998 Van Alen, II ..... A63B 53/02 473/245
5,782,005 A * 7/1998 Reilly, III ..... A63B 53/007 33/508
5,816,931 A * 10/1998 Schooler ..... A63B 53/02 473/248
6,017,281 A * 1/2000 Behling ..... A63B 53/0487 473/313
6,024,650 A * 2/2000 Reeves ..... A63B 53/02 473/287
6,048,275 A * 4/2000 Gedeon ..... A63B 53/007 473/293
6,328,662 B1 * 12/2001 Huang ..... A63B 53/0487 473/334
6,409,613 B1 * 6/2002 Sato ..... A63B 53/0487 473/337
6,511,387 B2 * 1/2003 Grieb ..... A63B 53/0487 473/330
6,634,956 B1 * 10/2003 Pegg ..... A63B 53/007 473/251
6,692,371 B2 * 2/2004 Berish ..... A63B 53/02 473/244
6,988,956 B2 * 1/2006 Cover ..... A63B 53/065 473/244
7,625,298 B2 * 12/2009 Bennett ..... A63B 53/0466 473/334
8,062,148 B1 * 11/2011 Farkas ..... A63B 53/0487 473/313
8,251,836 B2 * 8/2012 Brandt ..... A63B 53/007 473/340
D720,821 S * 1/2015 Brandt ..... D21/736
8,956,245 B2 * 2/2015 Brandt ..... A63B 53/007 473/340
9,079,077 B2 * 7/2015 Wolf ..... A63B 53/02
2014/0155191 A1 * 6/2014 Brandt ..... A63B 53/0487 473/330

FOREIGN PATENT DOCUMENTS

JP 09327535 A * 12/1997
JP 10024127 A * 1/1998
JP 10080507 A * 3/1998
JP 10174730 A * 6/1998 ..... A63B 53/02
JP 10192466 A * 7/1998
JP 10234901 A * 9/1998
JP 11235404 A * 8/1999
JP 2000140169 A * 5/2000
JP 2003010374 A * 1/2003
JP 2005192966 A * 7/2005
JP 2007209722 A * 8/2007
JP 2008012200 A * 1/2008
WO WO 2008082032 A1 * 7/2008 ..... A63B 53/0487

* cited by examiner

GOLF PUTTER HEAD ASSEMBLY AND METHOD OF USE

BACKGROUND OF THE INVENTION

This invention relates to a golf club, particularly a putter. More specifically, this invention related to a golf putter head assembly. This invention also relates to a method of use of a golf putter head assembly.

Golf players have long been searching for anything to improve their game. One area of inventiveness has been the golf club.

OBJECTS OF THE INVENTION

It is an object of the present invention to provide an improved golf club

It is a more specific object of the invention to provide an improved golf putter.

It is a more particular object of the present invention to provide a putter head assembly that enables and facilitates adjustment of the putter to the exigencies of a putting green and/or to the preferences of the user.

These and other objects of the present invention will be apparent from the drawings and descriptions herein. It is to be noted that any single embodiment of the invention may not achieve all of the objects of the invention, but that every object is attained by at least one embodiment.

SUMMARY OF THE INVENTION

A head assembly for a golf putter comprises, in accordance with the present invention, (i) a head piece, (ii) a hosel or connector for attaching a putter shaft to the head piece, and (iii) a releasable clamping element. The hosel has a body portion and a finger extension extending from the body portion. The body portion is formed with a concavity defined in major part by a cylindrical concave surface having an axis and a first radius of curvature. The finger extension has a bore for receiving an end of a putter shaft. The head piece includes an elongate body having a putting face on one side and a cylindrical convex surface on an opposite side. The cylindrical convex surface has a second radius of curvature approximately equal to and smaller than the first radius of curvature so that the cylindrical convex surface of the head piece is engageable with the cylindrical concave surface of the hosel. The cylindrical convex surface of the head piece is inserted into the concavity of the hosel so that the cylindrical convex surface is in contact with the cylindrical concave surface. The clamping element is operatively engageable with the hosel and the head piece to adjustably fix the hosel and the head piece to one another.

Pursuant to another feature of the present invention, the body portion of the hosel is further formed with a slot extending in a plane oriented perpendicularly to the axis of the cylindrical concave surface, while the head piece is provided with at least one internally threaded recess or hole with a respective opening located in the cylindrical convex surface. The clamping element preferably includes an externally threaded bolt extending through the slot and into the at least one recess or hole so as to releasably clamp and fix the head piece to the hosel.

In a preferred embodiment of the present invention, the recess or hole is one of a plurality of recesses or holes having respective openings located in the cylindrical convex surface, the recesses or holes being disposed at respective locations spaced from one another in a direction parallel to the axis. The recesses or holes are used for attaching the hosel to the head piece at different locations relative to the ends of the head piece, thereby enabling an adjustment of the toe-heel distances, or the distances of the ends of the head piece relative to the putter shaft. Preferably, the recesses or holes are disposed in a linear array, at an even spacing from one another. But variability in the inter-hole spacing is possible.

The head assembly may further comprise a washer element, so that the bolt extends through the slot and the washer element and into one or the other recess or hole so as to releasably clamp and fix the head piece to the hosel.

The hosel may be formed with a cylindrical outer surface opposite the cylindrical concave surface, with the slot penetrating through the cylindrical concave surface and the cylindrical outer surface. In that case, the washer element has a cylindrical surface engaging the cylindrical outer surface of the hosel. This facilitates an adjustment in the angle of the head piece relative to the hosel and particularly about the axis of the concavity in the hosel. This enables a user to vary the orientation of the putting face of the head relative to the shaft and accordingly relative to a putting surface (green). Tilting the putting head slightly forward results in an initial striking of a golf ball by the putting face slightly above the ball center, thus causing a rolling motion of the ball to initiate more quickly and reducing if not eliminating any initial sliding. Tilting the putting head slightly backward provides a struck ball with an incremental lift. The loft angle can help reduce friction through heavy or tall green grass.

Pursuant to a further feature of the present invention, the head piece is provided at opposite ends of the elongate body with two arms extending in parallel relationship to one another in a direction opposite the putting face. Preferably the arms are each provided at an end opposite the elongate body with a receptacle for removably receiving respective inserts each of predetermined weight. Preferably each of the inserts is one of a plurality of objects of like size and shape and of different predetermined weights, the objects being alternately disposable in the respective receptacle.

In accordance with another aspect of the present invention, each of the arms has an enlarged end section at an end opposite the elongate body of the head piece, the respective receptacles each being located in a respective enlarged end section.

In a particular embodiment of the present invention, each of the arms includes a plate extending in a plane perpendicular to the axis and further includes an arcuate end portion with a cylindrical outer or convex surface facing away from the head piece. The cylindrical outer or convex surfaces of the arcuate end portions may each be provided with a plurality of coaxial cylindrical ribs each located in a plane perpendicular to the axis.

In an alternative particular embodiment of the present invention, each of the arms is a linear bar provided at a free end, opposite the head piece, with an enlarged end portion.

A method for assembling a golf putter comprises, in accordance with the present invention, providing a hosel having a body portion and a finger extension extending from the body portion, the body portion being provided with a concavity defined in major part by a cylindrical concave surface having an axis and a first radius of curvature, the finger extension having a bore for receiving an end of a putter shaft. The assembly method further comprises providing a head piece including an elongate body having a putting face on one side and a cylindrical convex surface on an opposite side, the cylindrical convex surface having a second radius of curvature approximately equal to and smaller than the first radius of curvature. In another step of the assembly method, the head piece is inserted partially into the concavity of the hosel so that the cylindrical convex surface of the head piece engages the cylindrical concave surface of the hosel and is substantially coaxial therewith. Thereafter a releasable clamping element is operatively connected to the hosel and the head piece to adjustably fix the hosel and the head piece to one another.

Where the body portion of the hosel is further formed with a slot extending in a plane oriented perpendicularly to the axis of the concavity, and where the head piece is provided with at least one internally threaded recess or hole with a respective opening located in the cylindrical convex surface, the connecting of the clamping element to the hosel and the head piece includes inserting an externally threaded bolt through the slot and into the at least one recess or hole.

The method typically further comprises removing the bolt from the at least one internally threaded recess or hole, rotating the head piece relative to the hosel about the axis, repositioning the bolt relative to the slot and thereafter threading the bolt into the at least one recess or hole. This procedure enables a user to adjust the orientation of the putting face, tilting the face forward (at the top) to commence ball rotation earlier or tilting the face back (along the top edge) to provide a slight loft to the ball trajectory. The loft is such that the ball remains in contact with the green, but with reduced friction, at least during the beginning of a putting trajectory.

Where the recess or hole in the rear side of the putter head piece is one of a plurality of recesses or holes having respective openings located in the cylindrical convex surface, the recesses or holes being disposed at respective locations spaced from one another in a direction parallel to the axis, the method typically additionally comprises removing the bolt from the one internally threaded recess or hole, shifting the hosel and the head piece relative to one another in a direction parallel to the axis so that the slot is aligned with a different one of the recesses or holes, and thereafter threading the bolt into the one of the recesses or holes.

Where the clamping element includes a washer, the connecting of the clamping element to the hosel and the head piece includes inserting the bolt through the slot and the washer element and into the at least one recess or hole. Where the hosel has a cylindrical outer surface opposite the cylindrical concave surface, the slot penetrating through the cylindrical concave surface and the cylindrical outer surface, the method may more particularly includes moving the washer element relative to the hosel with a cylindrical surface of the washer element in engagement with the cylindrical outer surface.

Where the head piece is provided at opposite ends of the elongate body with two arms extending in parallel relationship to one another in a direction opposite the putting face, the arms being each provided at an end opposite the elongate body with at least one of at least two receptacles, the method may further comprise removably disposing two inserts each of predetermined weight in respective ones of the receptacles.

A particular embodiment of a related head assembly for a golf putter comprises, in accordance with the present invention, a hosel, a head piece, a bolt, and a washer element. The hosel has a body portion and a finger extension extending from the body portion. The body portion of the hosel is provided with a recess or concavity defined in major part by a cylindrical concave surface having an axis and a first radius of curvature. The body portion of the hosel is further formed with a slot extending in a plane oriented perpendicularly to the axis. The finger extension of the hosel has a bore for receiving an end of a putter shaft. The head piece includes an elongate body having a putting face on one side and a cylindrical convex surface on an opposite side. The cylindrical convex surface of the head piece has a second radius of curvature approximately equal to and smaller than the first radius of curvature (of the hosel concavity) so that the cylindrical convex surface is engageable with the cylindrical concave surface. The head piece is provided with a plurality of internally threaded recesses or holes with respective openings in the cylindrical convex surface, the recesses or holes being disposed at respective locations spaced from one another in a direction parallel to the axis. The bolt is threadable alternatively into different ones of the recesses or holes through the washer element that is placed into contact with the body portion of the hosel about the slot therein. The assembly may further comprises a set of inserts or objects of like size and shape and of different predetermined weights, the objects being alternately disposable in receptacles provided at the ends of a pair of arms which project from the elongate body of the head piece at opposite ends thereof.

A golf putter head assembly kit comprises, in accordance with the present invention, (i) a putter shaft having an externally threaded distal end; and (ii) a right-handed hosel and a left-handed hosel. Each hosel has a body portion and a finger extension extending from the body portion, the body portion being provided with a recess or concavity defined in major part by a cylindrical concave surface having an axis and a first radius of curvature, the body portion being further formed with a slot extending in a plane oriented perpendicularly to the axis, the finger extension having an internally threaded bore for receiving the externally threaded distal end of the putter shaft. The kit further comprises (iii) a putter head piece including an elongate body having a putting face on one side and a cylindrical convex surface on an opposite side, the cylindrical convex surface having a second radius of curvature approximately equal to and smaller than the first radius of curvature so that the cylindrical convex surface is engageable with the cylindrical concave surface of any selected one of the right-handed hosel and the left-handed hosel. The head piece is provided with a plurality of internally threaded recesses or holes with respective openings in the cylindrical convex surface, the recesses or holes being disposed at respective locations spaced from one another in a direction parallel to the axis. The kit also comprises (iv) an externally threaded bolt threadable alternatively into different ones of the recesses or holes and (v) a washer element.

The head piece of the kit is preferably provided with a plurality of recesses or receptacles, and the kit further comprises weighting elements of different weight values insertable into the recesses. Where the head piece includes a main body portion and a pair of arms extending from opposite ends of the main body portion in a direction opposed to the putting face, the recesses or receptacles including holes provided in the arms at ends thereof opposit the main body portion. The recesses or receptacles may include a pair of bores provided in the main body portion of the putter head at the opposite ends thereof.

DETAILED DESCRIPTION

Figure 1:
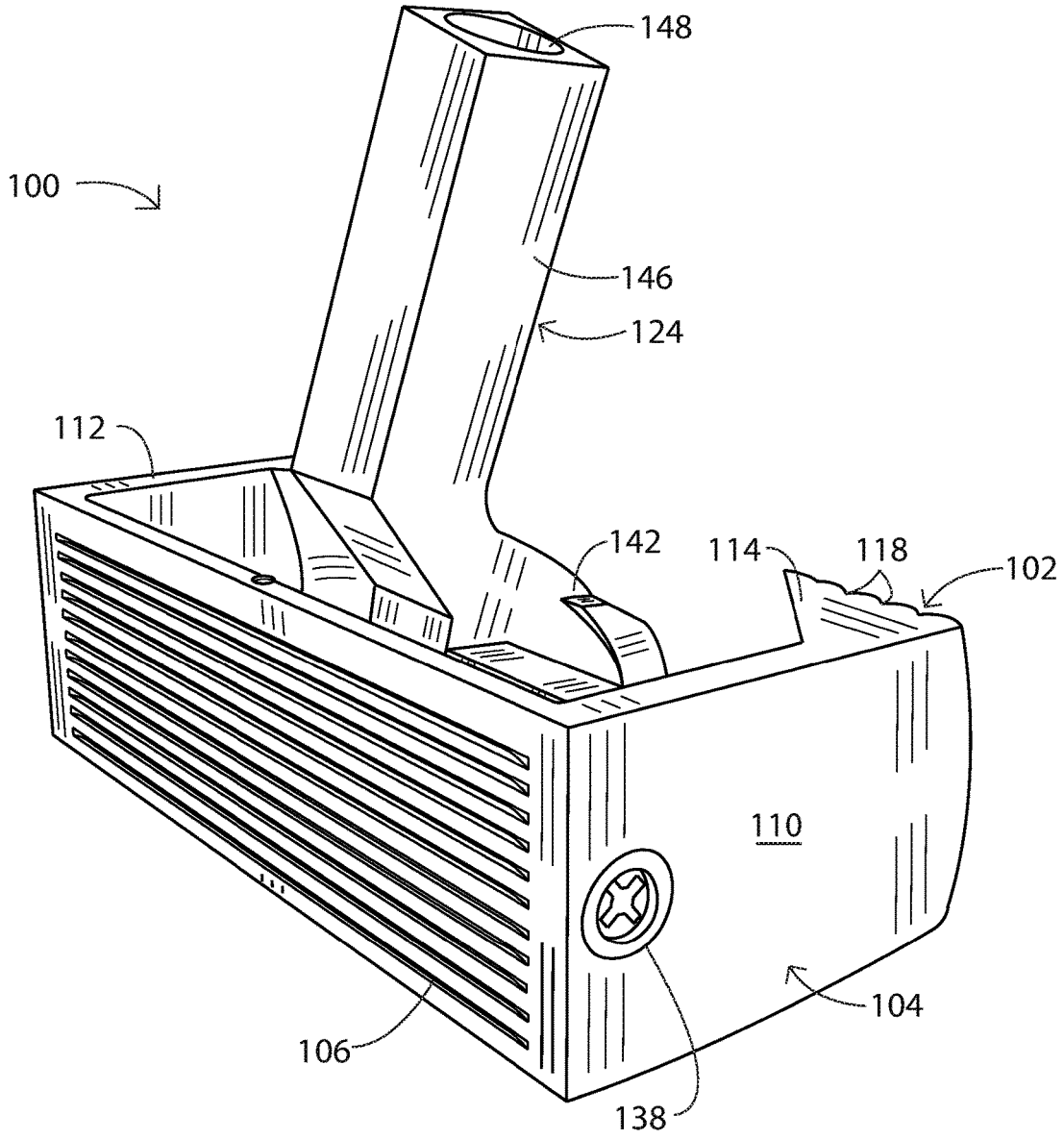
FIG. 1 is a top, front and left side perspective view of a putter head assembly in accordance with the present invention.
Figure 2:
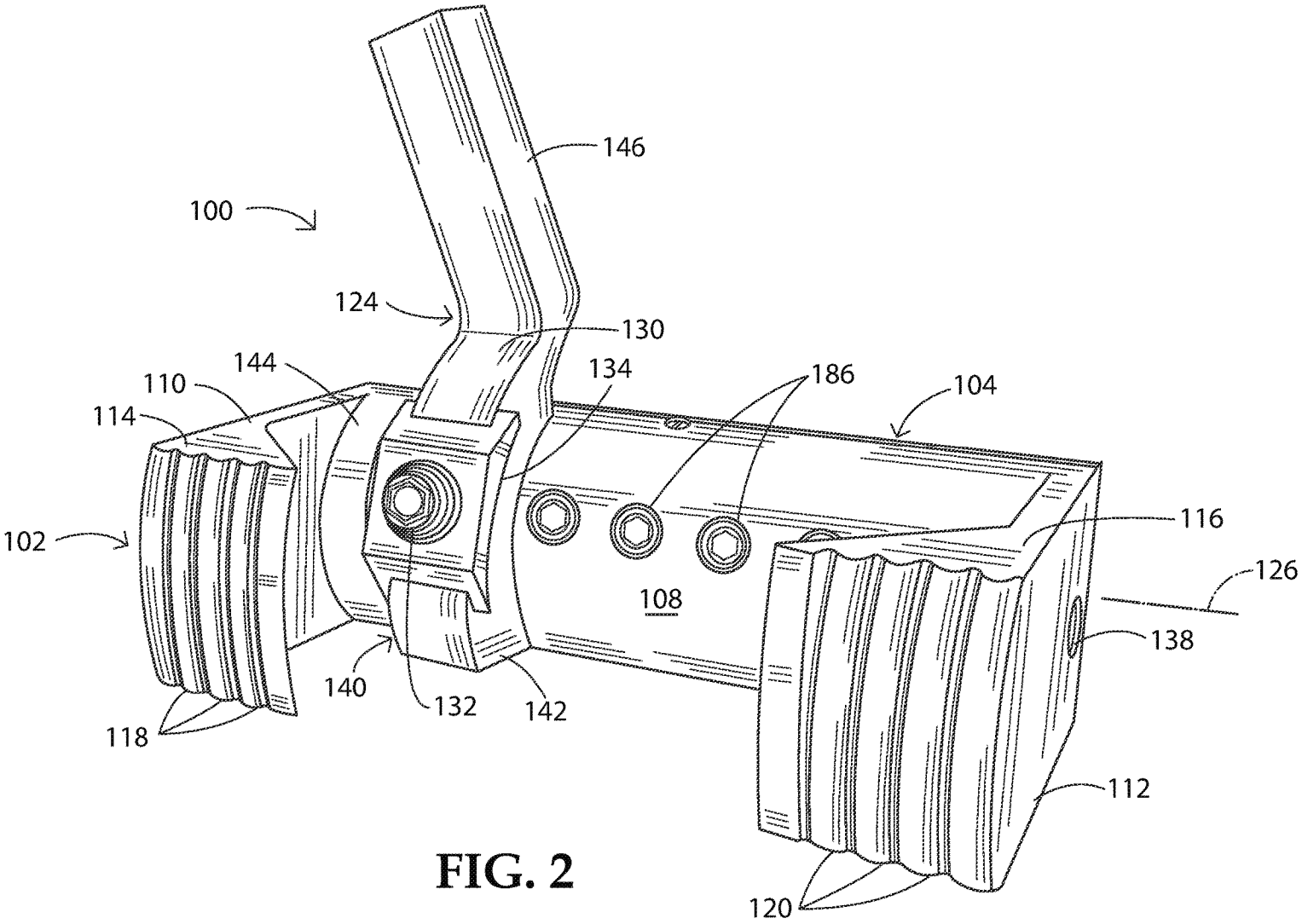
FIG. 2 is a top, rear and right side perspective view of the putter head assembly of FIG. 1.
Figure 3:
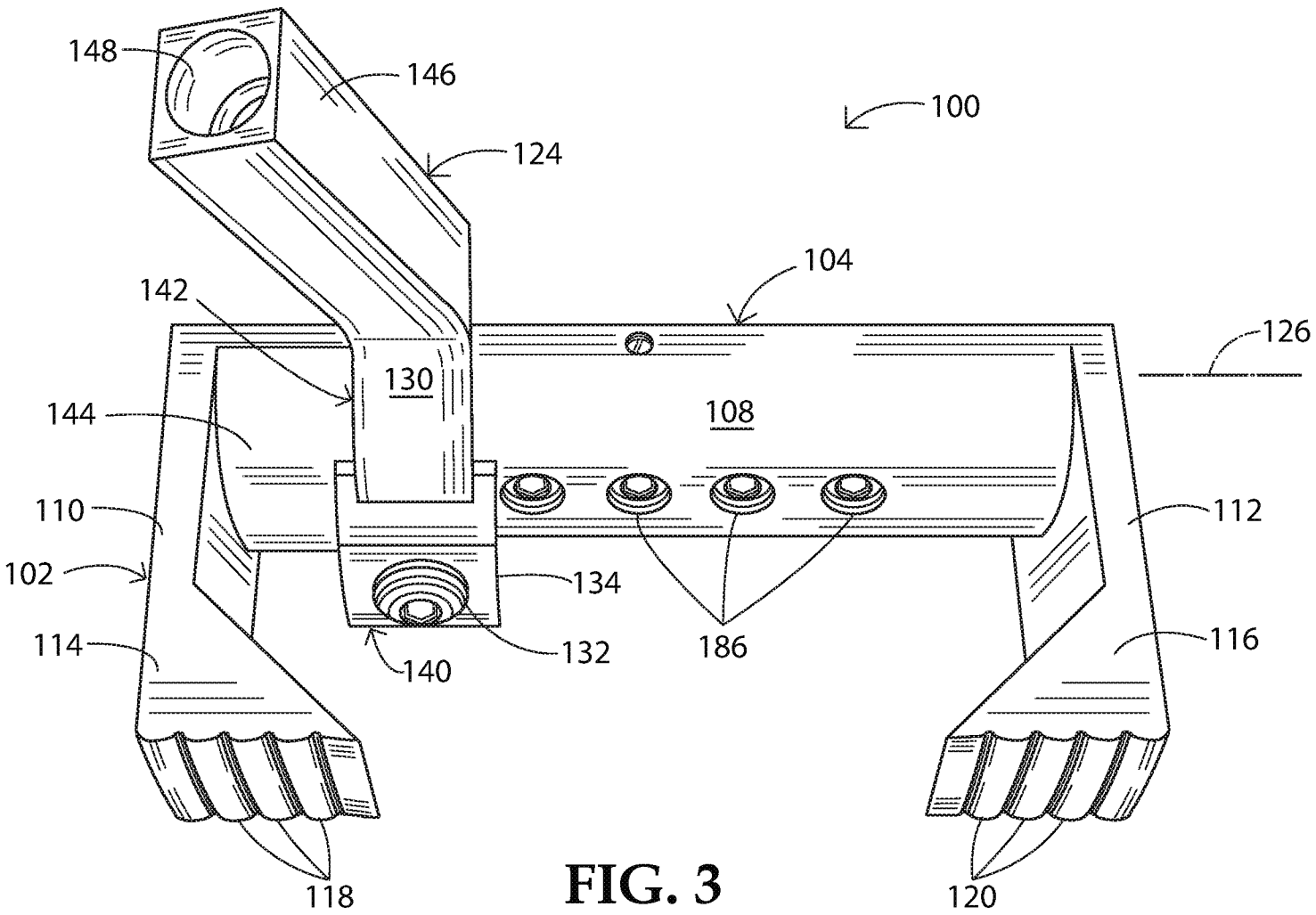
FIG. 3 is a rear and top perspective view of the putter head assembly of FIGS. 1 and 2.
Figure 4:
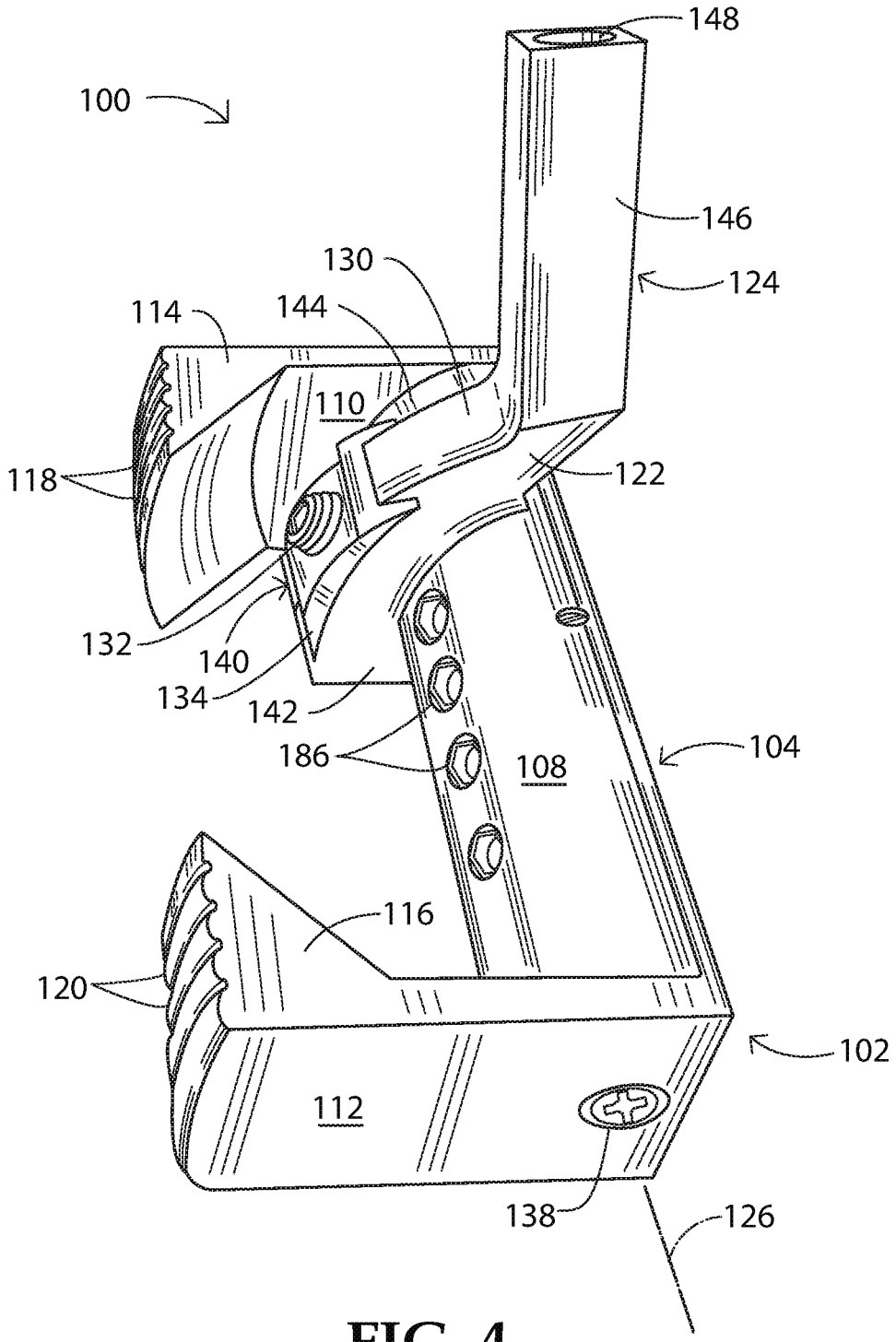
FIG. 4 is another top, rear and right side perspective view of the putter head assembly of FIGS. 1-3, from a different angle.
Figure 5:
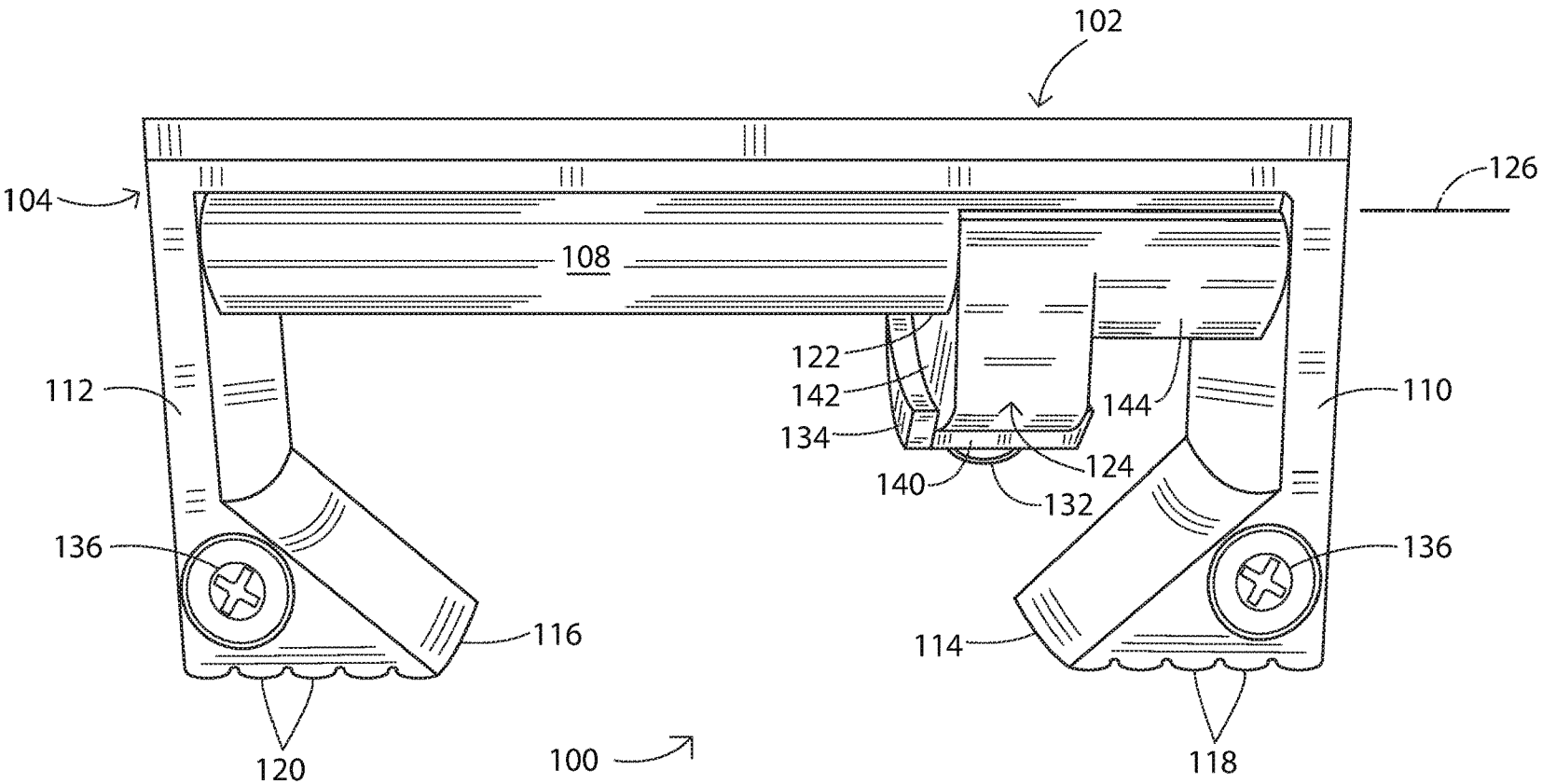
FIG. 5 is a bottom perspective view of the putter head assembly of FIGS. 1-4.
Figure 6:
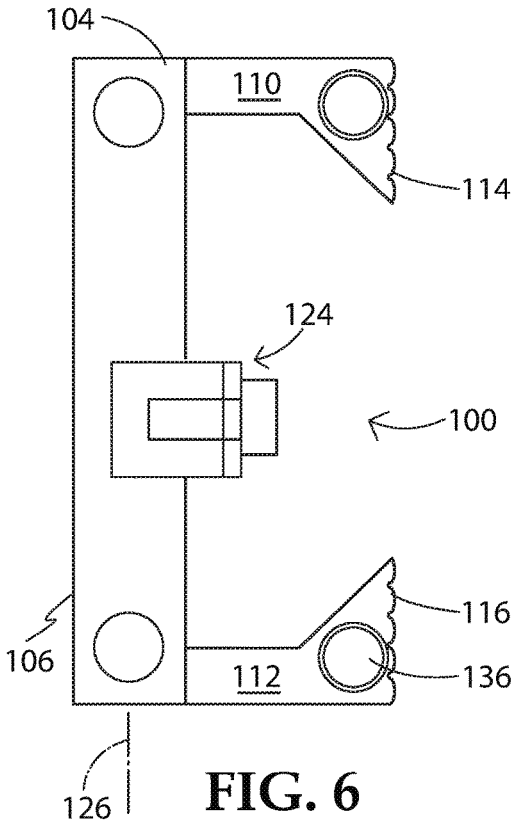
FIG. 6 is a schematic top plan view of the putter head assembly of FIGS. 1-5, partially in cross-section to show a hosel bolted onto a front section or head piece body at a chosen location and angle.
Figure 7:
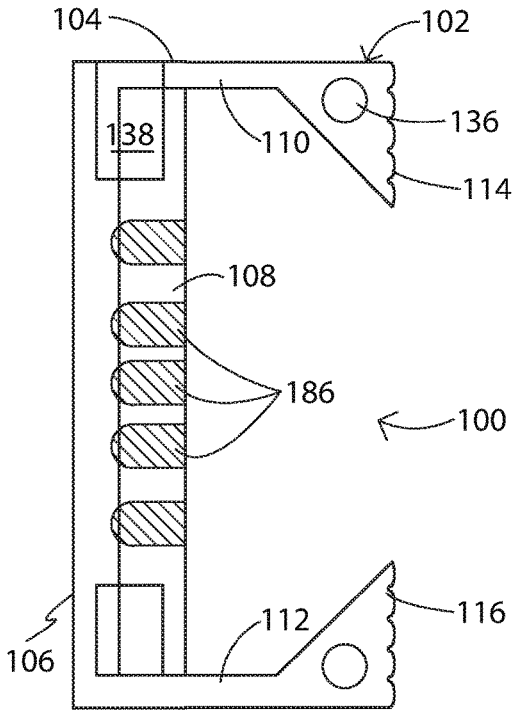
FIG. 7 is a schematic cross-sectional view taken parallel to the plane of the figure in FIG. 6, showing holes for hosel attachment and cylindrical weights inserted into the forward sides.
Figure 8:
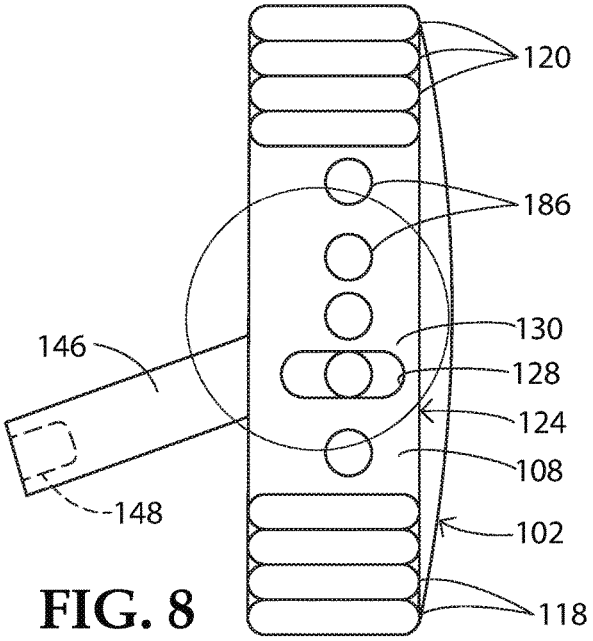
FIG. 8 is a rear elevational view of the putter head assembly, showing the holes for the hosel attachment.

FIGS. 1-8 depict a putter head assembly 100 with a head piece 102 having an elongate body 104 with a front face 106 that serves as a putting face or surface and a backward-facing side 108 that takes the form of a horizontal convex cylindrical section, and with rectangular side arms or bars 110 and 112 that terminate in enlarged triangularly prismatic free end sections 114 and 116. The enlarged end sections 114 and 116 are provided along rearward facing surfaces with a plurality of parallel ribs 118 and 120 of semi-circular cross-section. Convex cylindrical section 108 exhibits or defines a cylindrical convex surface (not separately labeled) that is inserted into a substantially coaxial concave cylindrical concavity or surface 122 of essentially the same, but incrementally larger, radius in a hosel member 124. By virtue of the matingly engageable cylindrical surfaces 108 and 122, hosel member 124 can slide both around and parallel to the elongate body 104 of the putter head piece 102 and fixed in place relative thereto.

By rotating the convex cylindrical section 108 of the putter head 102 within the concavity 122 of the hosel member 124, essentially about an axis 126 of the cylindrical concave surface 122, the loft angle of the putting face 106 can be set to a desired positive or negative value. By sliding the hosel member 124 parallel to the elongate body member 104 of the head piece 102, with concave surface 122 parallel to convex section or surface 108, the toe-heel location of the hosel member can be set to a desired position. The possible (horizontal) toe-heel positions are determined by the discrete backward-facing locations of threaded holes 186 residing in a linear horizontal array (parallel to axis 126) in the forward cylindrical section 108. See FIG. 6, which depicts five such holes 186.

Figure 9:
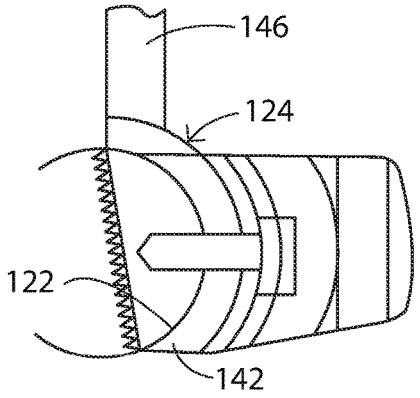
FIG. 9 is a schematic partial side view showing a front face of the putter head set at a 3° forward angle.
Figure 10:
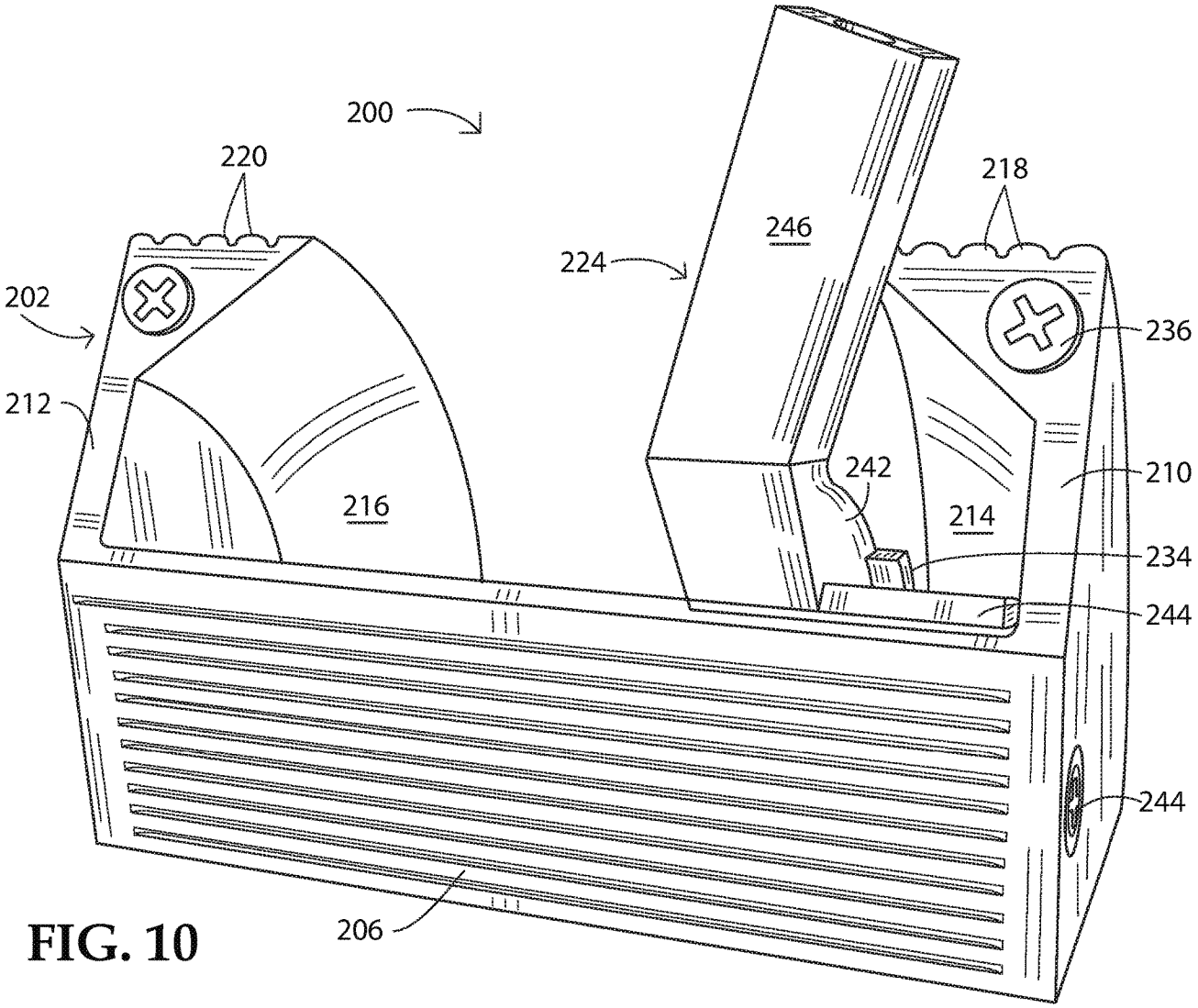
FIG. 10 is a top, front and left side perspective view of another putter head assembly in accordance with the present invention.
Figure 11:
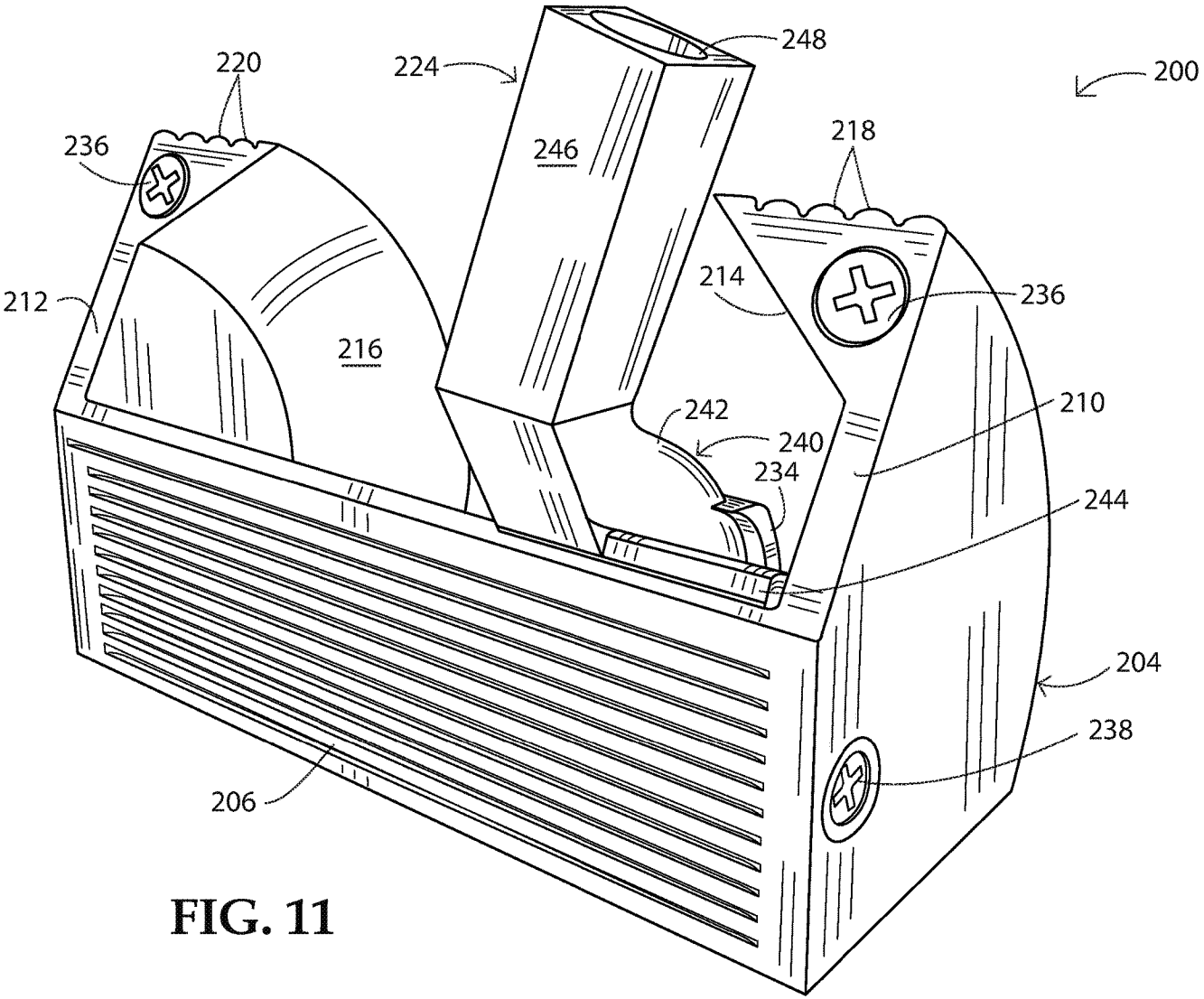
FIG. 11 is another top, front and left side perspective view similar to FIG. 9 but taken from more to the side of the putter head assembly.
Figure 12:
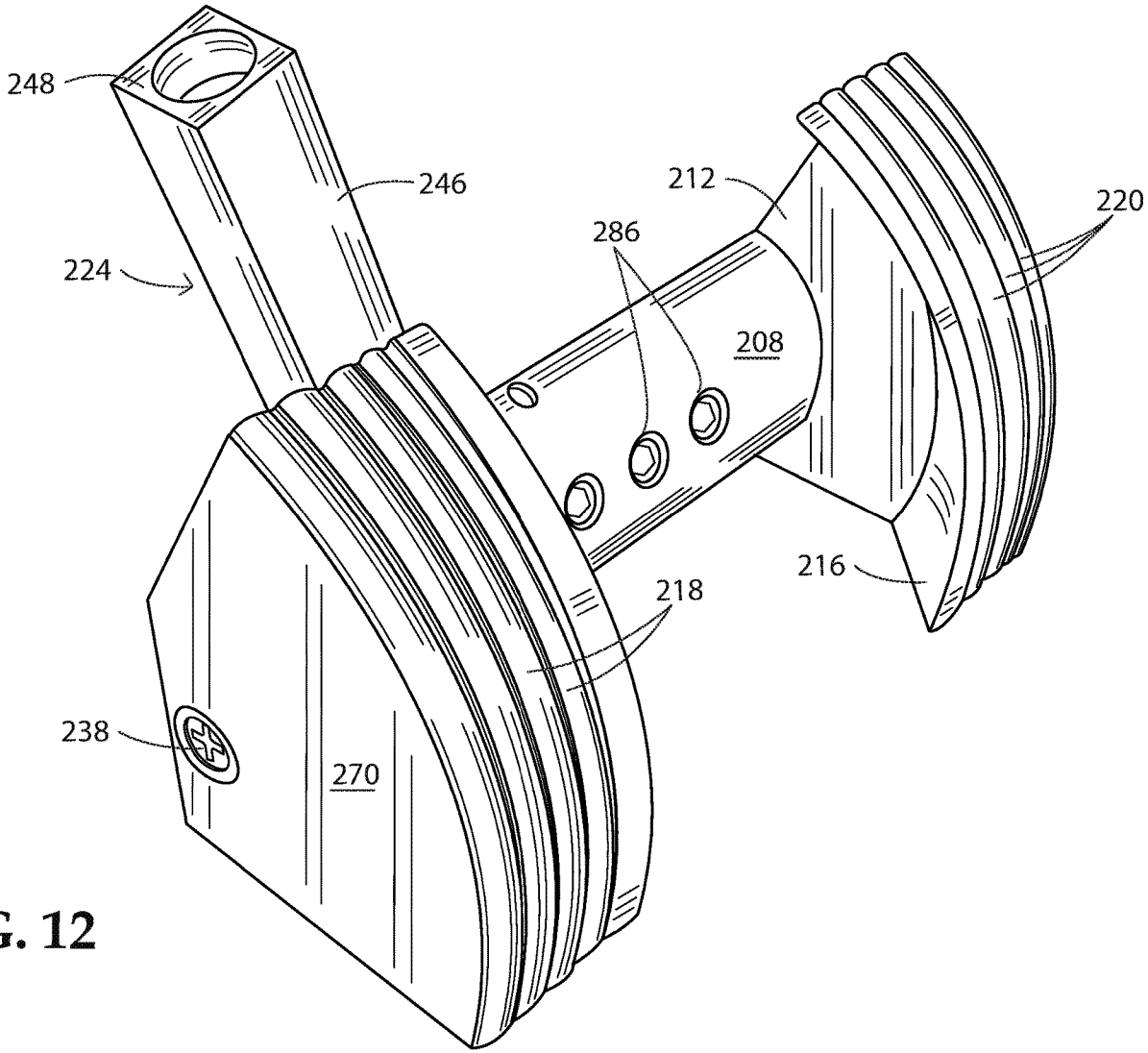
FIG. 12 is a top, rear and left side perspective view of the putter head assembly of FIGS. 10 and 11.
Figure 13:
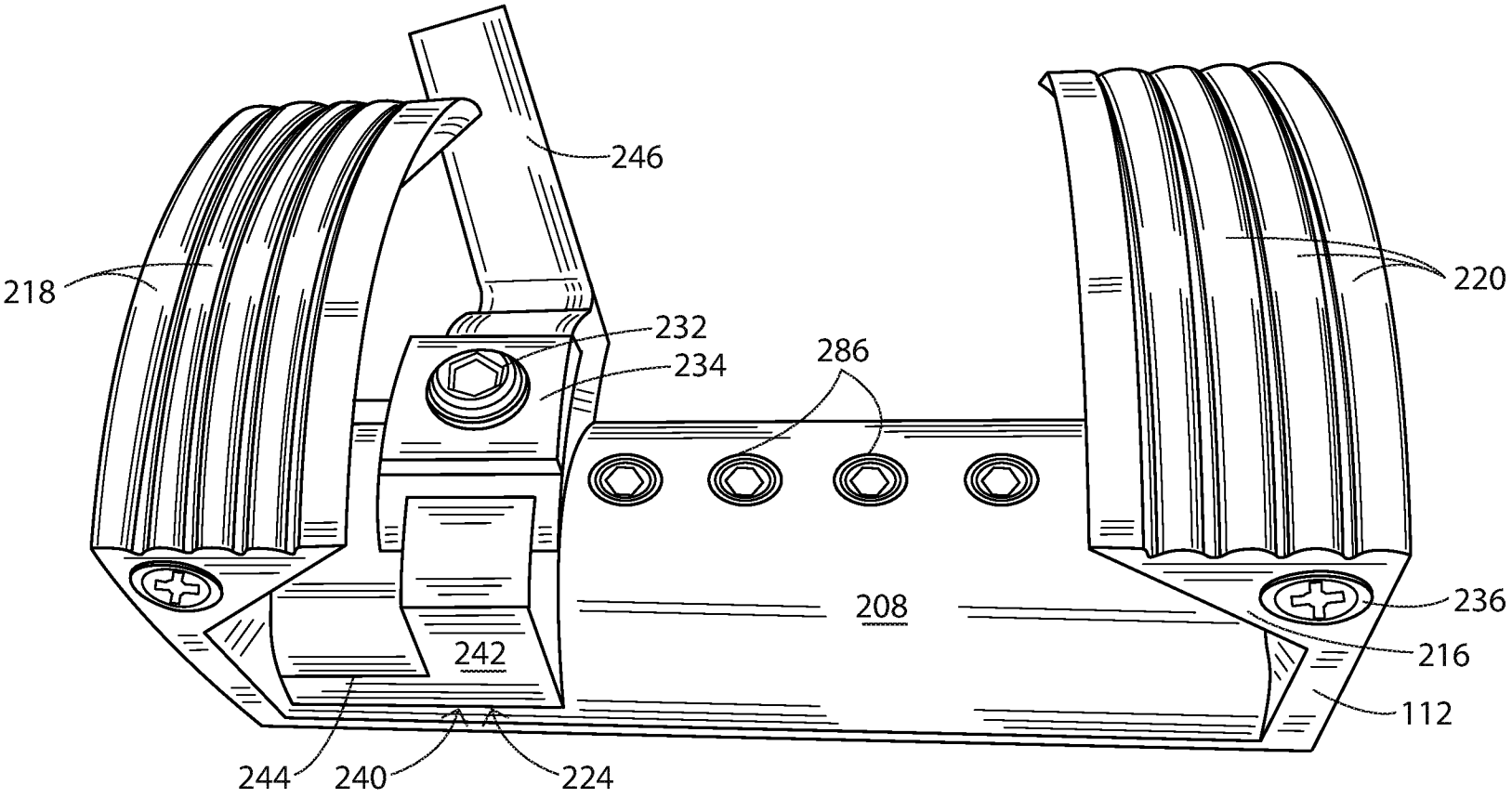
FIG. 13 is a rear and bottom perspective view of the putter head assembly of FIGS. 10-12.
Figure 14:
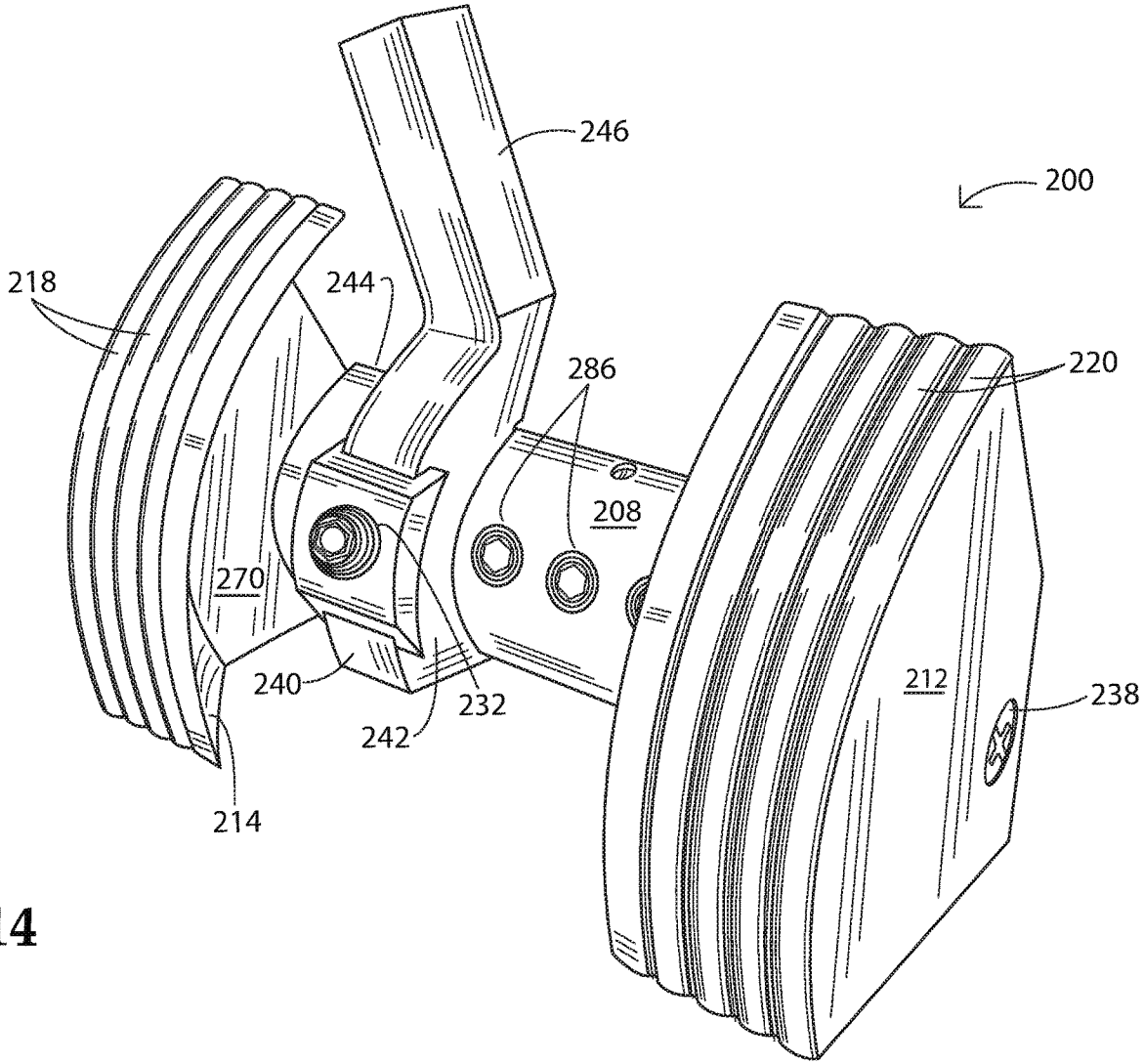
FIG. 14 is a top, read and right side perspective view of the putter head assembly of FIGS. 10-13.
Figure 15:
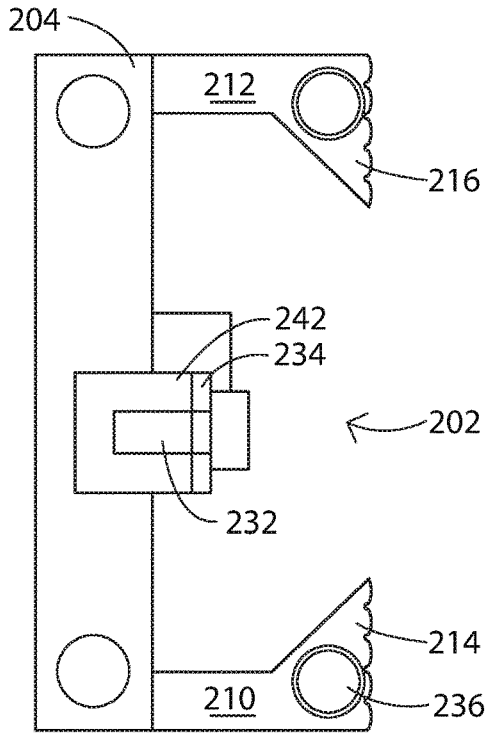
FIG. 15 is a schematic top plan view of the putter head assembly of FIGS. 10-14, partially in cross-section to show a hosel bolted onto a front section or head piece body at a chosen location and angle.
Figure 16:
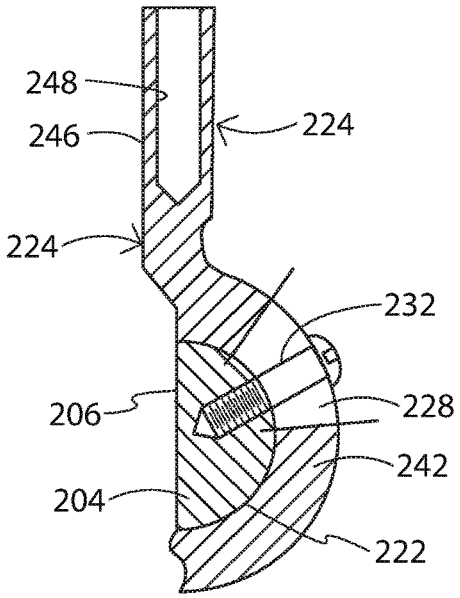
FIG. 16 is a schematic cross-sectional view taken along line XVI-XVI in FIG. 15, showing the hosel bolted into the front section at a selected angle.
Figure 17:
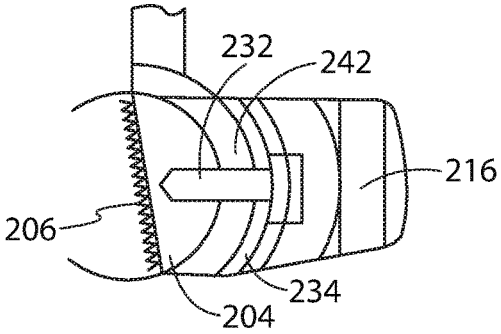
FIG. 17 is a schematic partial side view showing a front face of the putter head set at a 3° forward angle.
Figure 18:
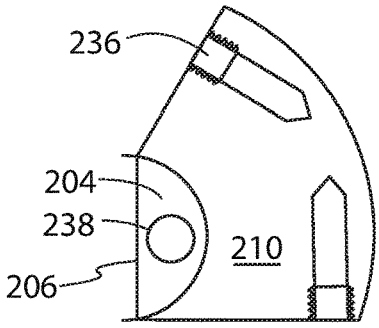
FIG. 18 is a schematic left side elevational view of the putter head assembly of FIGS. 10-17.
Figure 19:
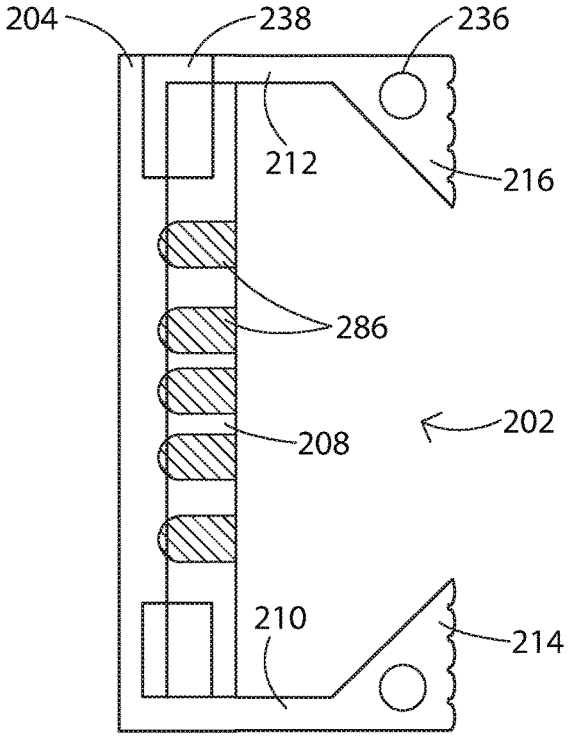
FIG. 19 is a schematic cross-sectional view taken parallel to the plane of the figure in FIG. 15, showing holes for hosel attachment and cylindrical weights inserted into the forward sides.

The possible loft angles vary continuously over a range determined by the size of a vertical slot 128 in a back side 130 of the hosel-attachment member 124. See FIGS. 8 and 9. The loft angle is set by tightening a clamping bolt 132 that extends through a compression washer 134 and through slot 128 and screws into a selected threaded hole 186 in the half-cylinder 108. The hosel-head attachment mechanism also allows for an easy change from a right-handed putter to a left-handed one, using the same head piece 102. (See FIG. 20.)

Weights 138 can be inserted into bores (not separated enumerated) in opposite sides of elongate body 104 of head piece 102. Additional weights 136 (FIG. 5) may be inserted into receptacles or bores (not separately designated) provided in the rear vertical triangular sections 114 and 116 to improve rotational stability and momentum transfer to a struck ball. A variety of different weights are available so that a golfer can choose the combination that produces his desired total club weight and balance, and these weight adjustments can be coordinated with the hosel placement.

A major advantage of the half-cylinder shape 108 of the elongate body 104 of the putter head piece 102 (with flat putting face 106 facing forward and cylindrical surface 108 facing backward) is that the configuration allows for rotation of the putter body 102 within the cylindrical concavity 122 of the hosel member 124 and a consequent range of possible loft angles of putter face 106. A face 106 slanted forward will impart forward spin onto a struck ball and will therefore decrease the time required for the ball to stop sliding and start the frictionless pure rolling phase of it's trajectory, but such a forward slant of putting face 106 will tend to direct the ball downward into the grass of the green. A face 106 slanted backward will tend to lift a struck ball over the grass, but will impart backward spin on the ball and delay the onset of pure rolling. Providing a golfer with a choice of face angles will enable him to adjust this angle to accommodate the prevailing conditions of the golf course greens.

A second advantage of the half-cylinder shape 108 of the forward section 104 is to concentrate the weight distribution of the elongate putter-head body 104 near the horizontal center of the putting face 106, where ball striking occurs. A conventional putter faceplate is equally thick behind all locations on the face and therefore puts less weight into an impact for a given total weight. In other words, a conventional putter requires more total weight to produce an optimal momentum transfer to a struck ball.

Putter head assembly 100 thus comprises head piece 102, hosel or connector 124 for attaching a putter shaft 150 (FIG. 20) to the head piece, and a releasable clamping element in the form of bolt 132 and preferably together with washer 134. The hosel member 124 has a body portion 140 including a main cylindrical section 142 and cylindrical flange section 144 projecting laterally of the main cylindrical section 142. Hosel member 124 further includes a finger extension 146 extending at a slant from the body portion 140 and having an internally threaded bore 148 for threadingly mating with a distal end of putter shaft 150. Hosel body portion 140 is formed with concavity or cylindrical concave surface 122, which forms the radially inside surface or boundary of the entire hosel body portion including body main cylindrical section 142 and extension flange 144.

Slot 128 extends through main cylindrical section 142 of hosel body 140 in a plane oriented perpendicularly to axis 126 of cylindrical concave surface 122.

Main cylindrical section 142 of hosel 124 exhibits a cylindrical outer surface 160, facing opposite cylindrical surface 122. Slot 128 penetrates outer surface 160 and inner surface 122. Washer element 134 includes a concave cylindrical surface 162 that engages hosel surface 160 and is slidable in contact therewith during a revolution of washer 134 about axis 126 to adjust the orientation of putting face 106.

FIGS. 10-19 depict a putter head assembly 200 with a head piece 202 having an elongate body 204 with a front face 206 that serves as a putting face or surface and a backward-facing side 208 that takes the form of a convex cylindrical horizontal section, and with arcuate side arms 210 and 212 that have enlarged triangularly shaped arcuate terminal sections 214 and 216. The enlarged terminal sections 214 and 216 are provided along rearward facing surfaces with a plurality of arcuate parallel ribs 218 and 220 of semi-circular cross-section. Ribs 218 and 220 are arranged in parallel planes all perpendicular to an axis of concave section 208. Convex cylindrical section 208 exhibits or defines a cylindrical convex surface (not separately labeled) that is inserted into a substantially coaxial concave cylindrical concavity or surface 222 of essentially the same, but incrementally larger, radius in a hosel member 224. By virtue of the matingly engageable cylindrical surfaces 208 and 222, hosel member 224 can slide both around and parallel to the elongate body 204 of the putter head piece 202 and fixed in place relative thereto.

By rotating the convex cylindrical section 208 of the putter head piece 202 within the concavity 222 of the hosel member 224, essentially about an axis 226 of the cylindrical concave surface 222, the loft angle of the putting face 206 can be set to a desired positive or negative value. By sliding the hosel member 224 parallel to the elongate body member 204 of the head piece 202, with concave surface 222 parallel to convex section of surface 208, the toe-heel location of the hosel member can be set to a desired position. The possible (horizontal) toe-heel positions are determined by the discrete backward-facing locations of threaded holes 226 residing in the forward cylindrical section 208. See FIG. 16, which depicts five such holes 226.

The possible loft angles vary continuously over a range determined by the size of a vertical slot 228 in a back side 230 of the hosel-attachment member 224. See FIGS. 13 and 14. The loft angle is set by tightening a bolt 232 that proceeds through a compression washer 234 through slot 228 and screws into a chosen threaded hole 226 in the half-cylinder 208. The hosel-head attachment mechanism also allows for an easy change from a right-handed putter to a left-handed one, using the same head. (See kit of FIG. 21, including right-handed hosel 224 and a left-handed hosel 252.)

Weights 236 can be inserted into bores (not separated enumerated) in opposite sides of elongate body 204 of head piece 202. Additional weights 238 may be inserted into receptacles of bores (not separately designated) provided in the arcuate enlarged terminal sections 214 and 216 to improve rotational stability and momentum transfer to a struck ball. A variety of different weights are available so that a golfer can choose the combination that produces his desired total club weight and balance, and these weight adjustments can be coordinated with the hosel placement.

Putter head assembly 200 thus comprises head piece 202, hosel or connector 224 for attaching a putter shaft 250 (FIG. 21) to the head piece, and a releasable clamping element in the form of bolt 232 and preferably together with washer 234. The hosel member 224 has a body portion 240 including a main cylindrical section 242 and cylindrical flange section 244 projecting laterally of the main cylindrical section 242. Hosel member 224 further includes a finger extension 246 extending at a slant from the body portion 240 and having an internally threaded bore 248 for threadingly mating with a distal end of putter shaft 250. Hosel body portion 240 is formed with concavity or cylindrical concave surface 222, which forms the radially inside surface or boundary of the entire hosel body portion 240 including body main cylindrical section 242 and extension flange 244.

Slot 228 extends through main cylindrical section 242 of hosel body 240 in a plane oriented perpendicularly to axis 226 of cylindrical concave surface 222.

Main cylindrical section 242 of hosel 224 exhibits a cylindrical outer surface 260, facing opposite cylindrical surface 222. Slot 228 penetrates outer surface 260 and inner surface 222. Washer element 234 includes a concave cylindrical surface 262 that engages hosel surface 260 and is slidable in contact therewith during a revolution of washer 234 about axis 226 to adjust the orientation of putting face 206.

Another advantage of the half-cylinder shape 108, 208 of the elongate putter body 104, 204 is to concentrate the weight distribution of the putter head piece 102, 202 near the horizontal center of the putting face 106, 206, where ball striking occurs. A conventional putter faceplate is equally thick behind all locations on the putting face and therefore puts less weight into an impact for a given total weight. In other words, a conventional putter requires more total weight to produce an optimal momentum transfer to a struck ball.

Figure 20:
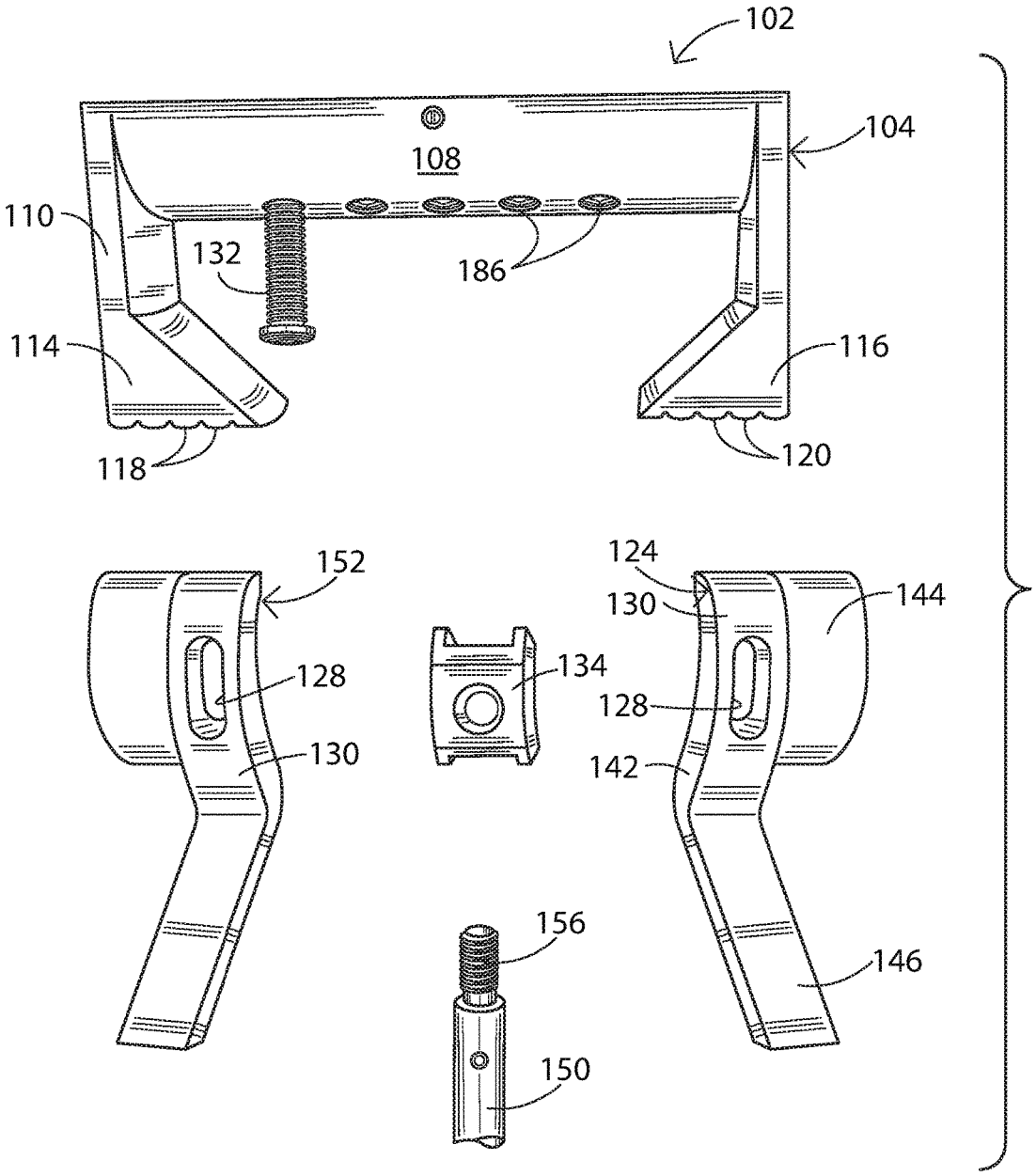
FIG. 20 is a perspective view of parts of a kit that can be used to assemble the first embodiment of a putter head assembly, per FIGS. 1-9, with dual oppositely inclined hosel members for left-handed and right-handed putter heads.
Figure 21:
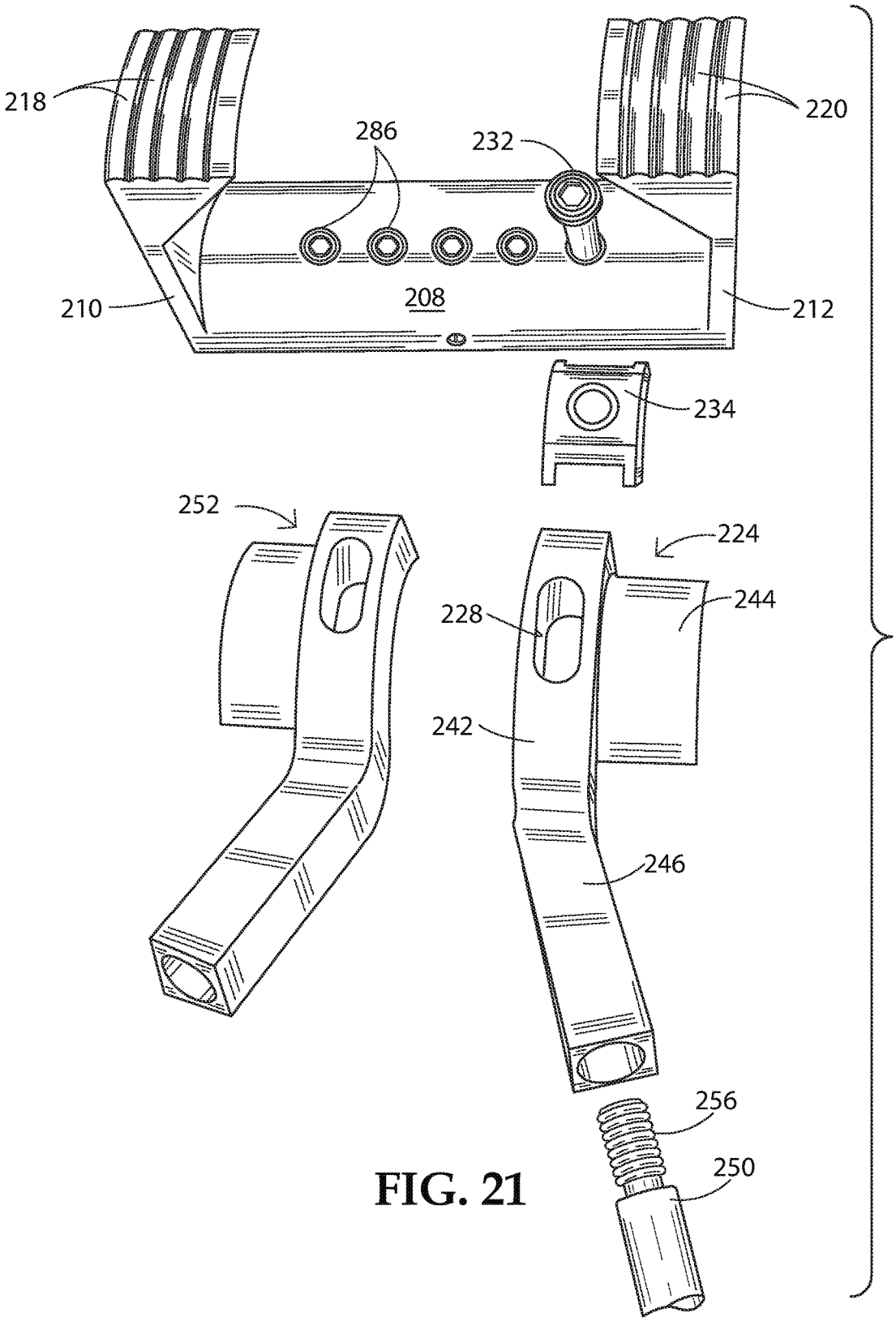
FIG. 21 is a perspective view of parts of a kit that can be used to assemble the second embodiment of a putter head assembly, per FIGS. 10-19, with dual oppositely inclined hosel members for left-handed and right-handed putter heads.

A hosel-head attachment mechanism as described herein also allows for an easy change from a right-handed putter to a left-handed one, using the same putter head piece 102, 202 and the same shaft, shown at 150, 250 in the kit depictions of FIGS. 20 and 21. The kits each include a respective right-handed hosel member 124 and 224 and a respective left-handed hosel member 152, 252. Hosel members 152 and 252 have shaft-receiving fingers 154 and 254 slanted towards the left instead of the right (when viewed from the front).

Shafts 150 and 250 preferably associated with the putter heads assemblies 100 and 200 terminate in threaded coupling sections 156 and 256 that can be screwed into the threaded holes 148 and 248 in the hosel finger extensions 146 and 246, allowing the golfer to change shafts when desired.

A method for assembling a golf putter utilizes hosel 124, 224, 152, or 252 and head piece 102 or 202. Head piece 102 or 202 is inserted partially into concavity 122 or 222 of the hosel 124, 224, 152, or 252 so that the cylindrical convex surface 108 or 208 of head piece 102 or 202 engages cylindrical concave surface 122 or 222 of the hosel 124, 224, 152, or 252 and is substantially coaxial therewith. Thereafter clamping bolt 132 or 232 is operatively connected to the hosel 124, 224, 152, or 252 and head piece 102 or 202 to adjustably fix the hosel 124, 224, 152, or 252 and the head piece 102 or 202 to one another.

The method typically further comprises removing bolt 132 or 232 from the selected threaded recess or hole 186 or 286, rotating the head piece 102 or 202 relative to the hosel 124, 224, 152, or 252 about the axis 126 or 226, repositioning the bolt 132 or 232 relative to the slot 128 or 228 and thereafter threading the bolt into the at least one recess or hole 186 or 286. This procedure enables a user to adjust the orientation of the putting face 106 or 206, tilting the face forward (at the top) to commence ball rotation earlier or tilting the face back (along the top edge) to provide a slight loft to the ball trajectory.

The method typically additionally comprises removing the bolt 132 or 232 from the one selected internally threaded recess or hole 186 or 286, shifting the hosel 124, 224, 152, or 252 and the head piece 102 or 202 relative to one another in a direction parallel to the axis 126 or 226 so that the slot 128 or 228 is aligned with a different one of the recesses or holes 186 or 286, and thereafter threading the bolt 132 or 232 into the newly aligned recess or hole 186 or 286.

The connecting of the clamping element 132, 232 to the hosel 124; 224, 152, or 252 and the head piece 102 or 202 includes inserting the bolt 132 or 232 through the slot 128 or 228 and the washer element 134 or 234 and into a recess or hole 186 or 286. Where the hosel 124, 224, 152, or 252 has a cylindrical outer surface 160 or 260 opposite the cylindrical concave surface 122 or 222, the method may more particularly includes moving the washer element 134 or 234 relative to the hosel 124, 224, 152, or 252 with a cylindrical surface 162 or 262 of the washer element 134 or 234 in engagement with the cylindrical outer surface 160 or 260 of the hosel main cylindrical section 142 or 242.

Where the head piece 102 or 202 is provided at opposite ends of the elongate body 104 or 204 with two arms 110, 112 or 210, 212 extending in parallel relationship to one another in a direction opposite the putting face 106 or 206, the arms being each provided at an end opposite the elongate body with at least one of at least two receptacles, the method may further comprise removably disposing two inserts 138 or 238 each of predetermined weight in respective ones of the receptacles.

Although the invention has been described in terms of particular embodiments and applications, one of ordinary skill in the art, in light of this teaching, can generate additional embodiments and modifications without departing from the spirit of or drawings and descriptions herein are proffered by way of example to facilitate comprehension of the invention and should not be construed to limit the scope thereof.

What is claimed is:

1. A head assembly for a golf putter, comprising:

a hosel having a body portion and a finger extension extending from said body portion, said body portion being provided with a concavity defined in major part by a cylindrical concave surface having an axis and a first radius of curvature, said finger extension having a bore for receiving an end of a putter shaft;

a head piece including an elongate body having a putting face on one side and a cylindrical convex surface on an opposite side, said cylindrical convex surface having a second radius of curvature approximately equal to and smaller than said first radius of curvature so that said cylindrical convex surface is engageable with said cylindrical concave surface, said cylindrical convex surface being inserted into said concavity so that said cylindrical convex surface is in contact with said cylindrical concave surface, said head piece being provided at opposite ends of said elongate body with two arms extending in parallel relationship to one another in a direction opposite said putting face, said head piece and said putting face having a width extending from an top side to a bottom side of said head piece, said arms having at free ends thereof opposite said elongate body a height extending between an upper side and a lower side of said arms, said height being at least substantially equal to said width; and a releasable clamping element operatively engageable with said hosel and said head piece to adjustably fix said hosel and said head piece to one another, each of said arms being a linear bar provided at a free end, opposite said head piece, with an enlarged end portion.

2. The head assembly defined in claim 1 wherein said arms are each provided at an end opposite said elongate body with a receptacle, further comprising at least two inserts each of predetermined weight and each removably disposed in a respective said receptacle.

3. The head assembly defined in claim 2 wherein each of said arms has an enlarged end section at said end opposite said elongate body, the respective receptacles each being located in a respective said enlarged end section.

4. A head assembly for a golf putter, comprising:

a hosel having a body portion and a finger extension extending from said body portion, said body portion being provided with a concavity defined in major part by a cylindrical concave surface having an axis and a first radius of curvature, said finger extension having a bore for receiving an end of a putter shaft;

a head piece including an elongate body having a putting face on one side and a cylindrical convex surface on an opposite side, said cylindrical convex surface having a second radius of curvature approximately equal to and smaller than said first radius of curvature so that said cylindrical convex surface is engageable with said cylindrical concave surface, said cylindrical convex surface being inserted into said concavity so that said cylindrical convex surface is in contact with said cylindrical concave surface, said head piece being provided at opposite ends of said elongate body with two arms extending in parallel relationship to one another in a direction opposite said putting face, said head piece and said putting face having a width extending from an top side to a bottom side of said head piece, said arms having at free ends thereof opposite said elongate body a height extending between an upper side and a lower side of said arms, said height being at least substantially equal to said width; and a releasable clamping element operatively engageable with said hosel and said head piece to adjustably fix said hosel and said head piece to one another, each of said arms including a plate extending in a plane perpendicular to said axis and further including an arcuate end portion with a cylindrical outer or convex surface facing away from said head piece.

5. The head assembly defined in claim 4 wherein said cylindrical outer or convex surface is provided with a plurality of coaxial cylindrical ribs each located in a plane perpendicular to said axis.

6. A method for assembling a golf putter, comprising:

providing a hosel having a body portion and a finger extension extending from said body portion, said body portion being provided with a concavity defined in major part by a cylindrical concave surface having an axis and a first radius of curvature, said finger extension having a bore for receiving an end of a putter shaft, said body portion being formed with a slot extending in a plane oriented perpendicularly to said axis;

providing a head piece including an elongate body having a putting face on one side and a cylindrical convex surface on an opposite side, said cylindrical convex surface having a second radius of curvature approximately equal to and smaller than said first radius of curvature, said head piece being provided with at least one internally threaded recess or hole with a respective opening located in said cylindrical convex surface;

inserting said head piece partially into said concavity so that said cylindrical convex surface engages said cylindrical concave surface and is substantially coaxial therewith;

operatively connecting a releasable clamping element to said hosel and said head piece to adjustably fix said hosel and said head piece to one another, the connecting of said clamping element to said hosel and said head piece including inserting an externally threaded bolt through said slot and into said at least one recess or hole; and removing said bolt from said at least one internally threaded recess or hole, rotating said head piece relative to said hosel about said axis, repositioning said bolt relative to said slot and thereafter threading said bolt into said at least one recess or hole.

7. The method defined in claim 6 wherein said head piece is provided at opposite ends of said elongate body with two arms extending in parallel relationship to one another in a direction opposite said putting face, said arms being each provided at an end opposite said elongate body with at least one of at least two receptacles, further comprising removably disposing two inserts each of predetermined weight in respective ones of said receptacles.

8. A golf putter head assembly kit comprising:

a putter shaft having an externally threaded distal end;

a right-handed hosel and a left-handed hosel each having a body portion and a finger extension extending from said body portion, said body portion being provided with a recess or concavity defined in major part by a cylindrical concave surface having an axis and a first radius of curvature, said body portion being further formed with a slot extending in a plane oriented perpendicularly to said axis, said finger extension having an internally threaded bore for receiving said externally threaded distal end of said putter shaft;

a head piece including an elongate body having a putting face on one side and a cylindrical convex surface on an opposite side, said cylindrical convex surface having a second radius of curvature approximately equal to and smaller than said first radius of curvature so that said cylindrical convex surface is engageable with said cylindrical concave surface of any selected one of said right-handed hosel and said left-handed hosel, said head piece being provided with a plurality of internally threaded holes with respective openings in said cylindrical convex surface, said holes being disposed at respective locations spaced from one another in a direction parallel to said axis, said head piece being provided with a plurality of bores;

an externally threaded bolt threadable alternatively into different ones of said holes;

weighting elements of different weight values insertable into said bores; and a washer element.

9. The kit defined in claim 8 wherein said head piece includes a main body portion and a pair of arms extending from opposite ends of said main body portion in a direction opposed to said putting face, said bores being provided in said arms at ends thereof opposite said main body portion.

10. The kit defined in claim 8, wherein said bores include a pair of bores provided in said main body portion at said opposite ends thereof.

* * * * *